US007784158B2

(12) United States Patent
Doyle

(10) Patent No.: US 7,784,158 B2
(45) Date of Patent: Aug. 31, 2010

(54) FABRIC FASTENER WITH TWIST LOCK CLIP

(76) Inventor: Kenneth Clark Doyle, 7 Fontaire, Coto De Caza, CA (US) 92679

( * ) Notice: Subject to any disclaimer, the term of this patent is extended or adjusted under 35 U.S.C. 154(b) by 618 days.

(21) Appl. No.: 11/804,614

(22) Filed: May 19, 2007

(65) Prior Publication Data

US 2008/0047110 A1 Feb. 28, 2008

Related U.S. Application Data

(63) Continuation-in-part of application No. 11/510,182, filed on Aug. 24, 2006, now Pat. No. 7,216,404.

(51) Int. Cl.
*E04B 1/40* (2006.01)
*A41F 1/00* (2006.01)

(52) U.S. Cl. ..... 24/114.12; 24/457; 24/459; 24/470; 24/72.5

(58) Field of Classification Search ..... None
See application file for complete search history.

(56) References Cited

U.S. PATENT DOCUMENTS 664,242 A 12/1900 Dowse
664,243 A 12/1900 Dowse
692,953 A 2/1902 White
806,521 A 12/1905 Childs
1,387,115 A 8/1921 Anderson
1,387,116 A 8/1921 Carr
1,399,730 A * 12/1921 Abe ..... 24/470
2,041,498 A 5/1936 Swidersky
2,435,082 A 1/1948 Huber
2,472,235 A * 6/1949 Sullivan ..... 24/470
4,221,028 A * 9/1980 Fischer ..... 24/457
4,502,256 A * 3/1985 Hahn ..... 52/63
4,985,968 A 1/1991 Hooper
5,727,290 A 3/1998 Gilbert et al.
5,926,920 A 7/1999 Denison

* cited by examiner

*Primary Examiner*—Jack W. Lavinder
(74) *Attorney, Agent, or Firm*—Gene Scott; Patent Law & Venture Group

(57) ABSTRACT

A spool has a pair of spaced apart plates mounted on opposing sides of a central core. A flexible fabric sheet is positioned in contact with a face of one of the plates of the spool and across a peripheral edge of the plate. A clip includes a pair of legs joined at one end and extending around the core of the spool with the fabric thereby forced into contact with the core. With the legs so inserted between the plates the fabric is captured in the spool so that the spool and clip are not able to move on the fabric or be dislodged from it. The legs terminate with toe curved in opposing lateral directions and which are able to be mutually interlocked in an overlapping attitude.

12 Claims, 2 Drawing Sheets

FABRIC FASTENER WITH TWIST LOCK CLIP

CROSS-REFERENCE TO RELATED APPLICATIONS

This is a continuation-in-part application of U.S. patent application Ser. No. 11/510,182, filed Aug. 24, 2006 now U.S. Pat. No. 7,216,404, and which is incorporated herein by reference.

STATEMENT REGARDING FEDERALLY SPONSORED RESEARCH OR DEVELOPMENT

BACKGROUND OF THE INVENTION

1. Field of the Present Disclosure

This disclosure relates generally to fasteners that may be mounted on a fabric sheet without damage to the sheet and without the use of any permanent element of the sheet such as a button hole or the like, and more specifically to a fastener of this type that may be used to tie the fabric sheet to a stationary fixture.

2. Description of Related Art Including Information Disclosed Under 37 CFR 1.97 and 1.98

Dowse, U.S. Pat. No. 684,242, discloses the combination in the socket or female member of a separable fastener of a socket-case, a plain ring of less diameter than the crown of the case, and the material between the case and ring, the case lying wholly on one side of the material, and the ring on the other side of the material.

Dowse, U.S. Pat. No. 664,243, discloses a method of covering and setting a socket-case of a fastener, which consists in placing the socket-case on the under side of the material, then fitting a retaining element over the material and socket-case, and then subjecting the socket-case to such a crushing pressure as to cause the flow of the metal in the crown of the socket-case to be restrained and directed to the sides thereof and the convexity of the metal from side to crown preserved.

White, U.S. Pat. No. 692,953, discloses a socket member of a ball-and-socket fastener, consisting of an outer shell having a restricted opening and a fastening-eyelet, the top of which is closed and depressed or re-curved, whereby the top may be expanded and locked within the shell.

Childs, U.S. Pat. No. 806,521, discloses a member having a head, a cord attached to the member, a spirally-coiled wire loop, an elastic member having its ends attached to the ends of the wire loop, the elastic member connected intermediate its ends to the cord, and means attached to the cord and elastic member for securing the device to a bed.

Anderson, U.S. Pat. No. 1,387,115, discloses a separable fastener comprising, in combination, a stud having a head and a neck, and a socket providing a spring having an opening at one side thereof and a spring casing, the spring and spring casing providing cooperating cam means tending to hold the spring closed about the neck of the stud entered there through when lateral strain is exerted between stud and socket.

Carr, U.S. Pat. No. 1,387,116, discloses a separable fastener comprising in combination, a stud having a head and a neck, and a socket containing a spring, the spring providing a stud-receiving aperture and an opening at one side thereof, the spring having oppositely disposed cam surfaces on each side of the opening, the cam surfaces all located on projections from the spring and adapted to cooperate with corresponding cam surfaces independent of the spring.

Abe, U.S. Pat. No. 1,399,730, discloses a sleeve holder comprising a member adapted to be positioned beneath the fold of a sleeve and having a base, a head and a connecting neck of reduced diameter, and an endless band having its normal interior diameter of less length than the diameter of the head and capable of being stretched over the head to engage the fold around the neck.

Swidersky, U.S. Pat. No. 2,041,498, discloses a socket structure for button and socket type fasteners comprising a back wall, a circular side wall, the side wall being provided with a front wall having a central circular opening therein, the front wall being provided with a break therein, the break in the front wall opening into the circular opening, the break defining edge portions of the front wall converging to the circular opening, so that a button with cloth thereon can be forced between the edges in sliding the button and cloth thereon through the break to the circular opening where the cloth on the button can expand to prevent displacement of the button from the socket.

Huber, U.S. Pat. No. 2,435,082, discloses an anchoring device for sheet material, the combination, which comprises, a rigid ring having an offset providing means for attaching a supporting element, and a resilient ring the pitch diameter of which in its free position is greater than that of the rigid ring, the resilient ring comprising an endless wire coil providing a continuous spring-like element adapted to be contracted to provide two substantially parallel coils connected at the ends whereby the resilient ring may be inserted through the rigid ring and expanded into a bulge of the sheet material positioned through the rigid ring.

Sullivan, U.S. Pat. No. 2,472,235, discloses a diaper fastener for securing overlapping folded corner portions of the diaper together comprising a flat button positioned under the overlapping positions with one side facing the same, a flat ring of larger outside diameter than the button and smaller inner edge diameter than the button disposed over the overlapping portions opposite the other side of the button with its inner edge folding the overlapping corner portions over and around the edge of the button and reversely folding the overlapping potions over and around the inner edge of the ring, whereby pull against the overlapping corner portions in a separate direction tends to urge the button and ring into clamping engagement to fasten the overlapping portions together, and a cord like connector for the button and ring attached at its ends to the button and ring and forming a loop straddling the overlapping portions, the ring being transversely split and resilient, for spreading apart to pass the button there through so that the ring may be disposed opposite the button with a snap action.

Hooper, U.S. Pat. No. 4,985,968, discloses a decorative body member that includes a safe and harmless separable, interlocking fastening device for engaging a portion of a garment there between. In one embodiment, an elongated ribbon is attached at one end to the body member and at the other to a pacifier, teething ring, or toy, to avoid loss. The fastener includes a circular pattern of fingers or prongs (female element) extending from the rear surface of the body member. The male element is a disk which is received within the fingers with the fabric there between. The disk is sufficiently large to prevent swallowing, and preferably includes an aperture through the center thereof to provide for passage of air if the disk should become lodged in the mouth or inadvertently swallowed.

Gilbert et al., U.S. Pat. No. 5,727,290, discloses a portable electronic device that ergonomically attaches to an external article that includes a housing for containing the portable electronic device and an ergonomic attachment device for attaching the portable electronic device to the external article. The ergonomic attachment device includes a first portion coupled to a contact portion on the portable electronic device, wherein the first portion has a first end and a second end and a second portion having a first end hinged to the first end of the first portion and a second end that clasps with the second end of the first portion, wherein the first portion and the second portion form a button holder that can ergonomically mount upon a button on the external article.

Denison, U.S. Pat. No. 5,926,920, discloses a snap-in adapter system that includes an interior piece having a circular interior face and a short cylindrical side wall forming a cylindrical recess, the recess having an interior diameter. The system also includes an exterior piece. The exterior piece has a circular exterior face with a diameter essentially equal to that of the diameter of the recess of the interior piece. The exterior piece also has a cylindrical projection. Also provided is an attachment means.

The related art described above discloses socket and retainer type devices for being mounted onto a fabric substrate. However, the prior art fails to disclose such an apparatus that is able to be locked in place by joining opposing legs in an interlocked attitude. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

Fasteners for attachment to fabric substrates without disturbing or puncturing the fabric are very well known in the art and several types are described above in the background section of this document. However, for certain uses, such common fasteners are not sufficient. For instance, the pull-out or disengagement force for this type of fastener is considered to be generally low. For applications such as holding a camping tarp or a tent flap, especially in high wind conditions, prior art fasteners are not effective. Under these conditions an eyelet permanently fastened to the fabric is required. However, there are many instance where such an eyelet is not available so that a fastener of the type described herein in the present invention is the only feasible solution. The present solution is novel in its construction and its ability to secure a fabric at an arbitrary location in a superior manner.

The present fastener uses a spool of the type described and shown in Sullivan, U.S. Pat. No. 2,472,235 and which is described and shown in the detailed description and drawing figures of this document. In the present disclosure, the spool has a pair of spaced apart plates mounted on opposing sides of a central core. A flexible fabric sheet is positioned in contact with a face of one of the plates of the spool and is further positioned across a peripheral edge of the plate. A clip which has a pair of legs joined at one end are placed around the core of the spool with the fabric thereby forced in a folded manner into contact with the core and an inside surface of the opposing plate. With the legs so inserted between the plates, the fabric is captured in the spool so that the spool and clip are not able to move on the fabric or be dislodged from it. The legs terminate with toes curved in opposing lateral directions and which are able to be mutually interlocked in an overlapping attitude which draws the legs into compression around the core. When this is done, holes in the toes become superimposed and therefore, the toes may be locked together by, for instance, a screw, a tie-wrap, a cord, or any other object that will fit through the holes. In this manner, the legs are secured about the spool and the fabric is also secured within the spool and cannot be dislodged without destroying the fabric or the fastener.

A primary objective inherent in the above described apparatus and method of use is to provide advantages not taught by the prior art.

Another objective is to provide a fastener that may be locked in place on a fabric.

A further objective is to provide such a fastener that may be secured at any location on the fabric.

A still further objective is to provide such a fastener that may be secured on the fabric with no permanent modification to the fabric.

A still further objective is to provide such a fastener the may be engaged with a cord or tie line that, under a tensile force tighten the fastener in place on the fabric.

A still further objective is to provide such a fastener that is able to be used to secure a fabric sheet by a line.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
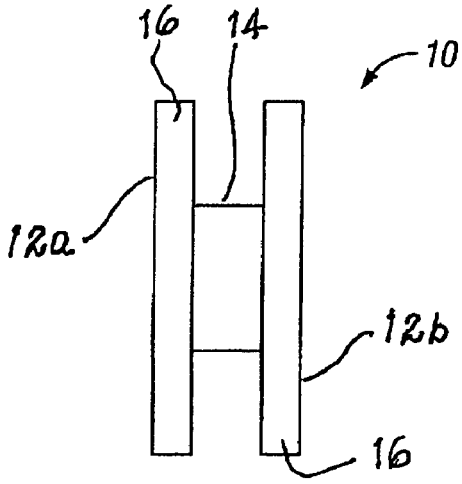
FIG. 1 is a side elevational view of a spool of the presently described apparatus.
Figure 2:
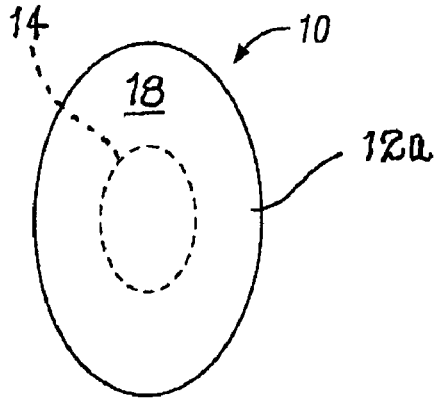
FIG. 2 is a frontal elevational view thereof.
Figure 3:
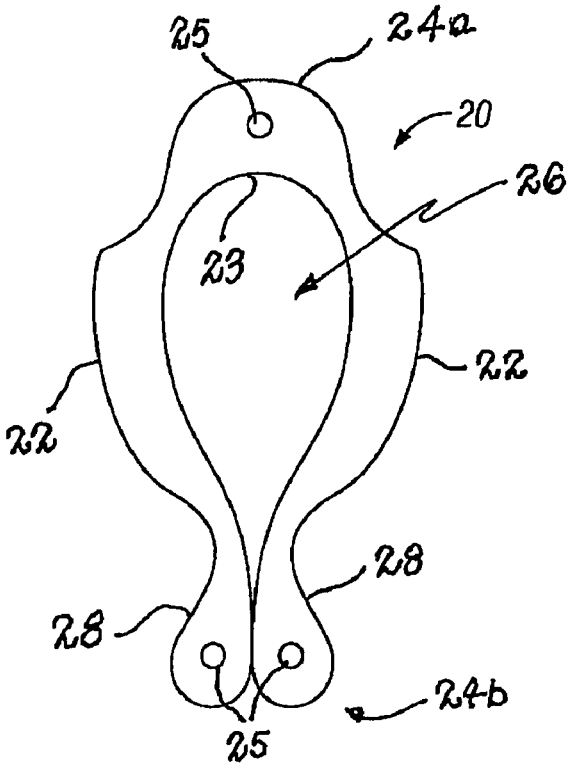
FIG. 3 is a frontal elevational view of a clip of the presently described apparatus showing legs of the clip in an unengaged attitude.
Figure 4:
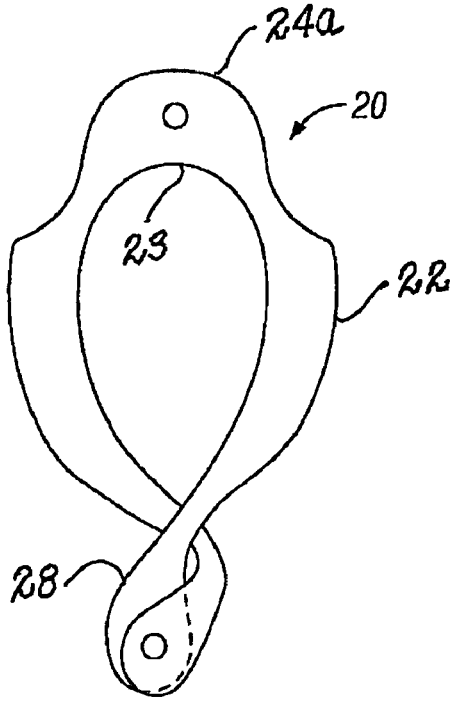
FIG. 4 is a frontal elevational view of the clip showing legs of the clip in an engaged attitude.

Described now in detail is a fastener apparatus for attaching a cord or line to a fabric sheet. The apparatus includes two separate parts, a rigid spool 10 (FIGS. 1 and 2) and a flexible clip 20 (FIGS. 3 and 4). The spool 10 is constructed with a pair of identical spaced apart plates 12*a* and 12*b* which are mounted on opposing sides of a central core 14. The spool 10 is preferably made of a hard plastic material but may also be made of wood, metal or other materials that are sufficiently rigid to function in the manner described herein. The clip 20 may be punched-out from a flat plastic plate stock, or may be injection molded or made by other well known manufacturing techniques.

Figure 5:
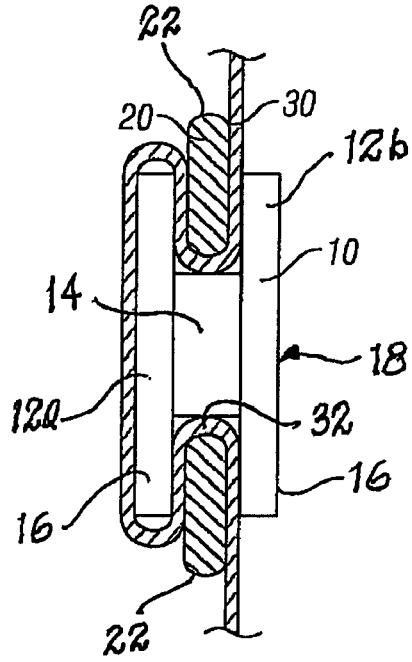
FIG. 5 is a horizontal sectional view taken along cutting plane 5-5 in FIG. 6 where the spool is not sectioned.
Figure 6:
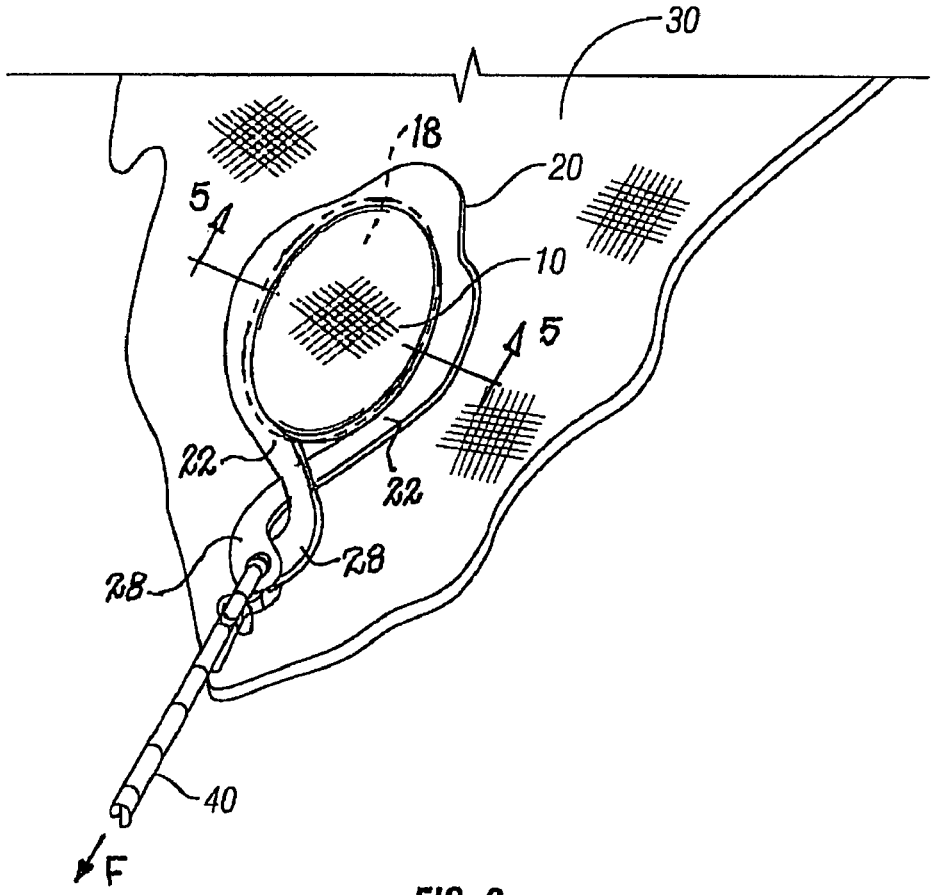
FIG. 6 is a perspective view of the spool and clip as mounted on a fabric and showing a cord or line engaged with the intertwined legs of the clip.

The clip 20 provides a pair of legs 22 joined at proximal end 24*a* of the clip 20, the legs 22 defining a central opening 26 therebetween. Each of the legs 22 terminates independently of the other with a toe 28 at a distal end 24*b* of the clip 20. The toes 28 are curved in mutually opposing lateral directions as shown in FIG. 3, and are shaped so that they are able to be interlocked when the legs 22 are drawn toward each other around the spool 10 and the toes 28 are placed in an overlapping attitude as illustrated in FIGS. 4 and 6. The clip 20 is made from a strong but somewhat flexible material such as polyurethane so that it will not break or stretch in use, but is able to be bent to intertwine the toes 28 as described and shown. The legs 22 are of such thickness as to tightly fit between the plates 12*a* and 12*b* with a fabric sheet placed intermediate the legs 22 and the plates as shown in FIG. 5.

Preferably, both of the toes 28 support a hole 25 therein, and a further hole 25 is preferably placed at the proximal end 24*a*. The holes 25 in the toes 28 are located for coaxial superimposition with one behind the other when the toes 28 are placed in the overlapping attitude as shown in FIG. 4.

Preferably, the plates 12*a* and 12*b*, and the core 14 of the spool 10 are non-round and preferably elliptical so that the clip 20 is not able to rotate about the core 14.

Preferably, the legs 22 are shaped so that the central opening 26 is near circular at the proximal end 24*a* of the clip 20 and are convergent at the distal end 24*b* of the clip 20.

It should be understood, that the above described apparatus, because of its novel features and capabilities represents only one embodiment or aspect of the conceptual novelty of the present invention. In a further embodiment, shown in FIG. 6, the above described apparatus is used in combination with a fabric sheet 30 which may be any fabric article such as a field kitchen tarp, a tent flap, a bedding sheet, or a clothing item. In this embodiment, the fabric sheet 30 is in contact with the face 18 of one of the plates, for instance, 12*a* and is then spread across the peripheral edge 16. The legs 22 of the clip 20 extend around the core 14 of the spool 10 which forces portions of the fabric sheet 30 that lie between the plates 12*a* and 12*b* and portions 32 to be pushed into contact with the core 14 as the legs 22 elastically press toward each other. The toes 28 of the legs 22 may be positioned as shown in FIG. 4, which, in itself, holds the clip 20 in place on the spool 10. To further assure that the toes 28 remain in the intertwined attitude and the entire assembly remains as shown in FIG. 6, an appropriate diameter object may be placed through holes 25. Such an object may be the cord 40 shown in FIG. 6 or any other relevant object, e.g., a screw, a wire, a tie-wrap, etc.

In a still further embodiment, the described apparatus is mounted on the fabric article 30 wherein the mounting method can only be practiced with the present apparatus because of the physical features of the present apparatus, primarily the linkable toes 28. Likewise, the above described apparatus is only able to be mounted and used in the presently described method to achieve the objectives of the invention.

The method of this invention includes the step of placing the fabric sheet 30 against the outer surface 18 of one plate 12*a*, and in fact either of the plates 12*a* or 12*b* may be used interchangeably as they are preferably identical, but may differ in size or shape. Next, the fabric 30 is pressed across the circumferential edge 16 of plate 12*a* and directed toward the further plate 12*b* of the spool 10. Next, the clip 20 is pushed around the core 14 between the plates 12*a* and 12*b* so that the core 14 is positioned between the opposing legs 22 of the clip 20 and a portion 32 of the fabric sheet 30 is thereby pressed against and the core 14. Finally, the toes 28 of the legs 22 are overlapped and intertwined, thereby forcing the legs 22 into intimate contact around the core 14. The restraining line 40 may now be threaded through the holes 25 in the toes 28, knotted, and lead away as shown in FIG. 6. The tensile force, shown by arrow "F" in FIG. 6, causes the clip 20 to move distally in the direction of the force "F" thereby assuring that the proximal edge 23 of opening 26 is secured between plates 12*a* and 12*b* and fabric portion 32 is compressed between edge 23 and core 14; and the legs 22 are also thereby pulled so as to compress the fabric portion 32 tightly against the core 14. In this manner the spool 10 and clip 20 act to secure the apparatus to the fabric sheet 30.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A fastener apparatus comprising: a rigid spool having a pair of spaced apart plates, the plates mounted on opposing sides of a central core; a flexible clip of essentially flat stock, the clip providing a pair of legs joined at a proximal end of the clip, the legs defining a central opening there between; each of the legs terminating with a toe at a distal end of the clip, the toes of the legs curved in opposing lateral directions; the toes shaped so as to be interlocked when each of the legs is drawn toward the other of the legs so that the toes are placed in an overlapping attitude.

2. The apparatus of claim 1 wherein each of the toes supports a hole therein.

3. The apparatus of claim 2 wherein the holes in the toes are axially superimposed when the toes are placed in the overlapping attitude.

4. The apparatus of claim 1 wherein the clip supports a hole therein at the proximal end thereof whereby the clip may be secured by a string.

5. The apparatus of claim 1 wherein the plates and the core are each non-round in shape.

6. The apparatus of claim 5 wherein the plates and the core are each elliptical in shape.

7. The apparatus of claim 1 wherein the central opening is near circular at the proximal end of the clip and convergent at the distal end of the clip.

8. A combination apparatus comprising: a spool having a pair of spaced apart plates, the plates mounted on opposing sides of a central core; a flexible fabric sheet positioned in contact with a face of one of the plates of the spool and drawn across a peripheral edge of the one of the plates; a flexible clip of essentially flat stock material providing a pair of legs, the legs joined at a proximal end of the clip and therefrom extending around the core of the spool with the fabric thereby clamped between the legs and the core; each of the legs terminating with a toe at a distal end of the clip, the toes intertwined in an overlapping attitude thereby aligning holes in the toes.

9. The apparatus of claim 8 wherein each of the toes supports a hole therein, the holes axially superimposed.

10. The apparatus of claim 9 further comprising a cord threaded through the holes and extending away from the clip.

11. A method for fastening a spool; on to a fabric sheet, the method comprising the steps of:

a) placing the fabric sheet against an outer surface of one plate of a spool;

b) drawing the fabric sheet across a circumferential edge of the one plate and toward a further plate of the spool;

c) pushing a flexible clip of essentially flat stock material around a core of the spool between the one plate and the further plate, with the core positioned between opposing legs of the clip and a portion of the fabric sheet wedged between the legs and the core; and d) overlapping and intertwining distal toes of the legs, thereby compressing the core and the fabric sheet between the legs and thereby aligning holes in the respective toes.

12. The method of claim 11 further comprising the step of threading a cord through the aligned holes in the toes of the clip and directing the cord away from the clip with a tensile force.

* * * * *